US006174181B1

(12) United States Patent
Lai

(10) Patent No.: US 6,174,181 B1
(45) Date of Patent: Jan. 16, 2001

(54) CARD CONNECTOR

(75) Inventor: Ming-Chun Lai, Hsin-Chuang (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/429,751

(22) Filed: Oct. 28, 1999

(30) Foreign Application Priority Data

Dec. 28, 1998 (TW) ..... 87221637

(51) Int. Cl.[7] ..... H01R 13/635
(52) U.S. Cl. ..... 439/159
(58) Field of Search ..... 439/159, 160, 439/152–158

(56) References Cited

U.S. PATENT DOCUMENTS 5,145,389 * 9/1992 Okubo ..... 439/159
5,451,168 * 9/1995 Shuey ..... 439/159

* cited by examiner

*Primary Examiner*—Gary F. Paumen
(74) *Attorney, Agent, or Firm*—Wei Te Chung

(57) ABSTRACT

A card connector of the present invention comprises a dielectric housing, a plurality of conductive terminals, an extraction plate and a push rod. A cylindrical locking member is disposed in an upper surface of the dielectric housing, an annular flange extending from an upper edge thereof, the annular flange diametrically oppositely defining a pair of notches therein. The extraction plate defines a locking hole and a pair of tags corresponding to the flange of the locking member and the pair of notches. This arrangement assures engagement of the extraction plate with the locking member at a specific angle. The extraction plate is thus securely mounted to the locking member to form a pivotal mechanism. A force applied to one end of the push rod causes the extraction plate to rotate about the locking member, thereby extracting a card from the card connector.

1 Claim, 5 Drawing Sheets

CARD CONNECTOR

BACKGROUND OF THE INVENTION

The present invention relates to a card connector, and particularly to a card connector used for receiving an electrical card and electrically connecting the card to an electrical device to transmit electrical signals.

With the development of the computer industry and particularly notebook computers, electronic components having smaller volumes and higher capabilities are required. However, some components can not be mounted into notebook computers because of the mini-volume and reduced weight required. Card connectors have been adapted to remedy the shortfall. The cards used generally have a relatively large number of terminals to provide enough signal paths for transmitting a great number of signals quickly. However, a relatively large retention force exists between a mated card and the terminals of the card connector, so it-is often difficult to eject the card. Therefore, it is desirable to provide an ejection mechanism to facilitate ejection of a card from a card connector. Conventional ejection mechanisms for card connectors are very complicated, as described in Taiwan Patent Application Nos. 83215629, 84112148 and 86205493. As shown in FIG. 6, a prior art ejection mechanism comprises at least a fixed plate 51, an ejection plate 52, an actuator 53 and a push rod 54. The fixed plate 51 is firmly fixed to both sides of a connector housing 6. The ejection plate 52 is received within the card receiving passageway, an engaging slot 521 being located at a middle of the ejection plate 52, and ejection tabs 522 being formed at opposite ends of the ejection plate 52. The actuator 53 firmly interconnects with the fixed plate 51 at a pivot 533, and the actuator 53 rotates about the pivot 533. A tag 531 projects from one end of the actuator 53 for locking the engaging slot 521 of the ejection plate 52, the other end of the actuator 53 has an engaging tongue 532 for engaging with the locking slot 541 in a distal end of the push rod 54. An opposite end of the push rod 54 provides a "finger shelf" on which to push when actuating the ejector 5. When a force is applied to the push rod 54, the actuator 53 is rotated by the force being transmitted from the locking slot 541 to the engaging tongue 532 of the actuator 53. Since the actuator 53 rotates about the pivot 533, the tag 531 at the other end of the actuator 53 moves in a direction opposite to that of the engaging tongue 532. Since the tag 531 engages with the engaging slot 521 in the ejection plate 52, the ejection plate 52 is moved in the direction of extraction, ejecting the card. However, the conventional ejection mechanism is too complex and difficult to assemble, so its cost is relatively high. In addition, because of its complicated design, improper connection of one component can cause poor actuating capability. Additionally, some parts for conventional card connectors need to be machined (pivots for instance), thereby increasing the cost.

Hence, an improved card connector is required to overcome the disadvantages of the prior art.

BRIEF SUMMARY OF THE INVENTION

A prime object of the present invention is to provide a card connector having a pivotally operating ejection mechanism which improves assembly efficiency and decreases manufacturing cost.

A second object of the present invention is to provide a card connector having fewer parts and a simpler design, achieving the same ejection purpose at less cost.

A further object of the present invention is to provide a card connector including an ejection mechanism which can be applied to a variety of electronic apparatus having pivoting mechanisms, allowing the same mechanism to be used in different ways with different electronic apparatus.

The present card connector comprises a dielectric housing, a plurality of conductive terminals, an extraction plate and a push rod. A locking member is located in a recess defined in the upper surface of the dielectric housing, and the extraction plate of an ejection mechanism defines a locking hole for engaging with the locking member. The locking hole receives the locking member at a specific angle to form a pivotal mechanism. The pivotal mechanism can not disengage with the locking member in normal operation. A force is applied to actuate pivotal movement of the ejection mechanism, thereby extracting a card from the card connector.

The locking member is cylindrical in shape and integrally formed with the dielectric housing, an annular flange extending from a top edge of the locking member. The annular flange defines a pair of diametrically opposite notches. A periphery of the locking hole defined in the extraction plate forms a pair of tags respectively corresponding to the notches of the flange. Therefore, when the extraction plate is mounted to the locking member to form the pivotal mechanism, after rotating the extraction plate, the extraction plate is locked to the housing. A force applied to a push button of the push rod causes the extraction plate to rotate about the locking member, thereby ejecting the card from the card connector.

Other objects, advantages and novel features of the invention will become more apparent from the following detailed description of the present embodiment when taken in conjunction with the accompanying drawings.

DETAILED DESCRIPTION OF THE INVENTION

Figure 1:
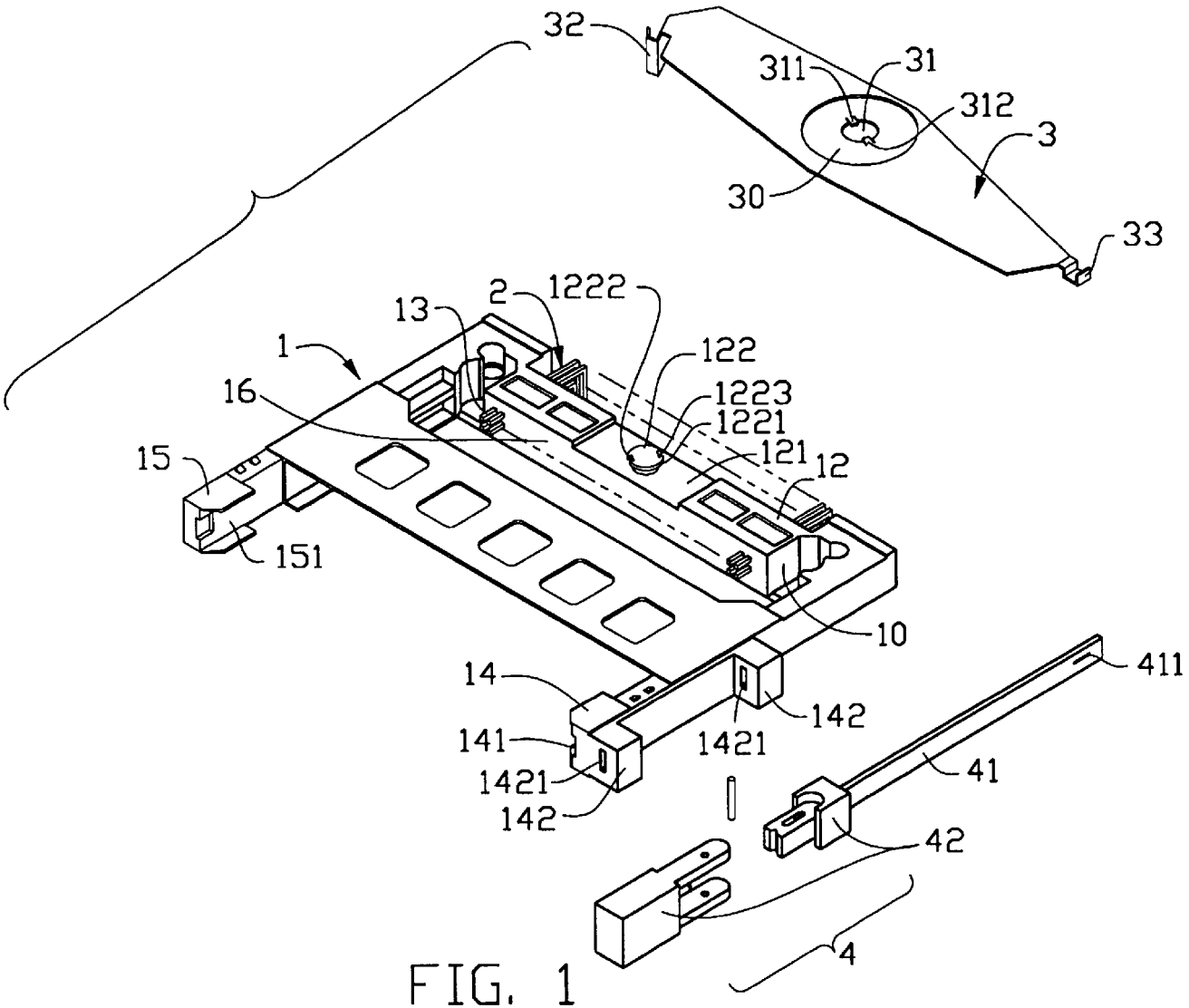
FIG. 1 is a partially disassembled view of the present invention.

Referring to FIG. 1, the present card connector comprises a dielectric housing 1, a plurality of conductive terminals 2, an extraction plate 3 and a push rod 4. The dielectric housing 1 is integrally formed, having a header body 10, an upper surface 12 being defined in the header body 10. Rows of terminal-receiving passageways 13 are defined through the header body 10 for receiving the terminals 2 therethrough. A pair of guiding arms 14, 15 extends from opposite ends of the header body 10. The opposite inner surfaces of the guiding arms 14, 15 respectively define card-receiving grooves 141, 151 used for receiving and guiding a card (not shown) to mate with the terminals 2. A pair of receiving protrusions 142 are integrally formed on an outer surface of the guiding arm 14, each defining a slot 1421 for receiving the push rod 4. A recess 121 is defined in a middle of the upper surface 12 of the dielectric housing 1. A cylindrical locking member 122 is integrally formed with the recess 121, an annular flange 1221 extending from a top edge thereof. The annular flange 1221 defines a pair of diametrically oppositely spaced notches 1222, 1223 for aligning engagement of the locking member 122 with the extraction plate 3. The terminals 2 are received within the terminal-receiving passageways 13 of the dielectric housing 1 and have one end projecting from a mating face 16 for engaging with a card, and a second end protruding from a mounting face 11 (FIG. 2) and bending downward for soldering to a printed circuit board.

The extraction plate 3 is integrally formed from a metal plate. A recessed portion 30 is formed in the central portion of the extraction plate 3 and defines a locking hole 31 slightly larger than the diameter of the flange 1221 of the locking member 122 of the dielectric housing 1. A periphery of the locking hole 31 forms a pair of tags 311, 312 corresponding to the notches 1222, 1223 of the flange 1221 of the locking member 122. The diameter of the space between inside edges of the tags 311, 312 is slightly larger than the diameter of the locking member 122. An extraction piece 32 extends from one end of the extraction plate 3 for pressing against an inserted card. A U-shaped locking hook 33 extends from an opposite end of the extraction plate 3 for engaging with a locking slot 411 in one end of the push rod 4.

The push rod 4 includes a lever 41 connecting with the extraction plate 3 and a push button 42 adapted to allow a swinging movement of an end part thereof. The locking slot 411 is formed in a distal end of the lever 41 for engaging with the locking hook 33 of the extraction plate 3. A proximal end opposite the distal end is pivotally connected to the push button 42. The push button 42 can be rotated to be in line with or perpendicular to the lever 41 according to the requirements of operation.

Figure 2:
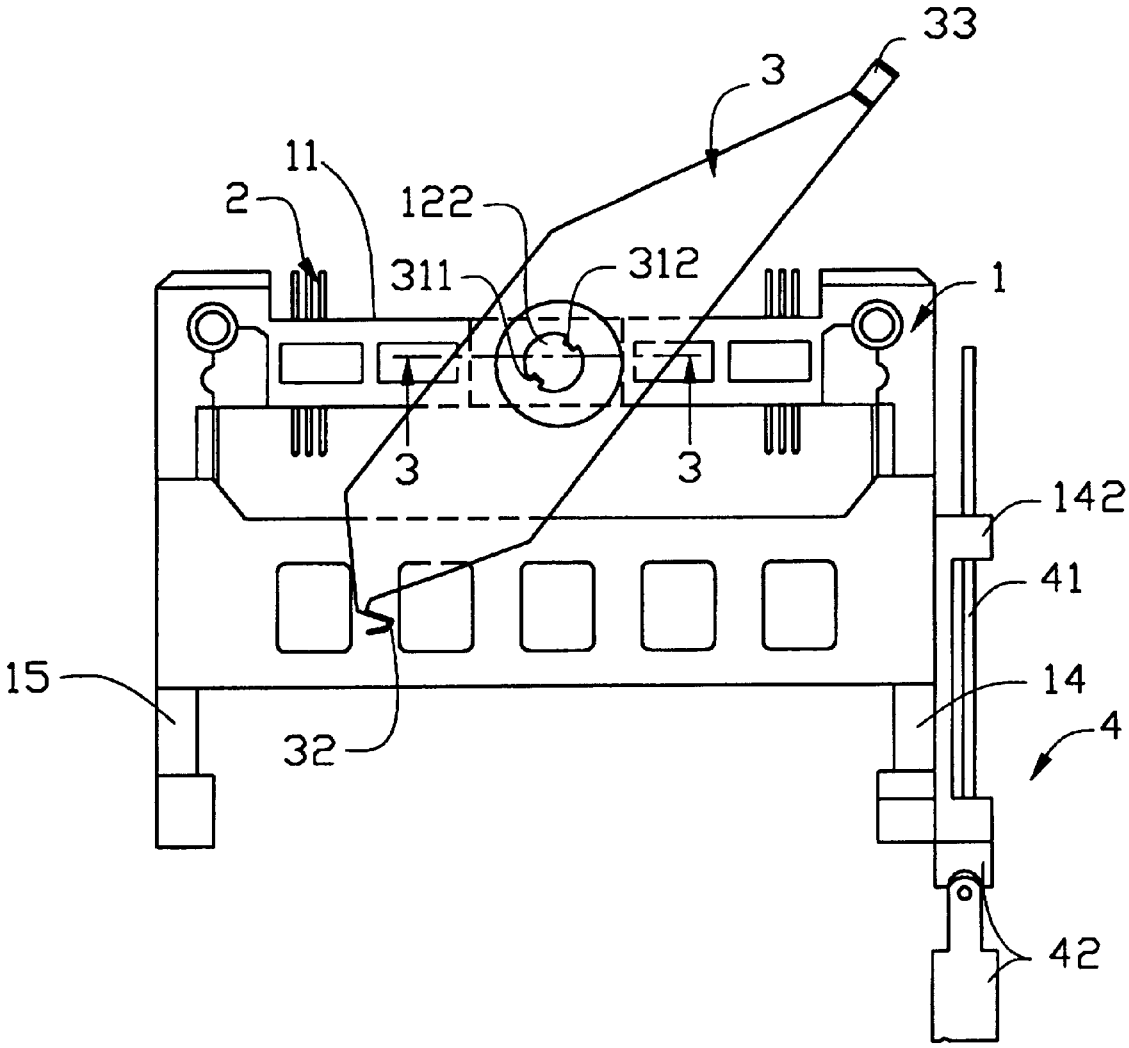
FIG. 2 is a top view of the present invention illustrating an extraction plate being assembled to a locking member.
Figure 3:
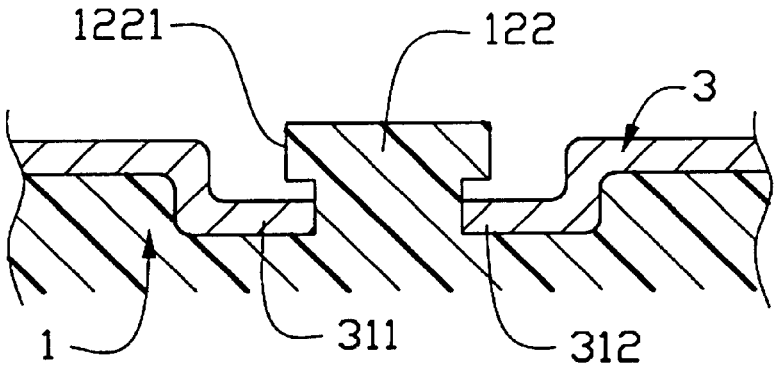
FIG. 3 is a sectional view taken along lines 3—3 of FIG. 2.

Referring to FIG. 2, in assembly, the tags 311, 312 of the extraction plate 3 are aligned with the notches 1222, 1223 of the flange 1221 of the locking member 122 which is located on the dielectric housing 1. The tags 311, 312 are accommodated by the notches 1222, 1223 of the flange 1221 permitting the flange 1221 on the locking member 122 to be received in the locking hole 31. Thus, the extraction plate 3 is mounted to the surface of the dielectric housing 1 and, after rotating the extraction plate 3, the extraction plate 3 is locked to the housing 1 (see FIG. 3). The tags 311, 312 align with the notches 1222, 1223 when the extraction plate 3 is oriented at a high angle to the housing 1, thereby assuring that normal operation will not cause the extraction plate 3 to disengage from the housing 1. The lever 41 is received within the slots 1421 defined in the receiving protrusions 142 of the dielectric housing and the locking hook 33 of the exaction plate 3 is engaged with the locking slot 411 of the lever 41.

Figure 4:
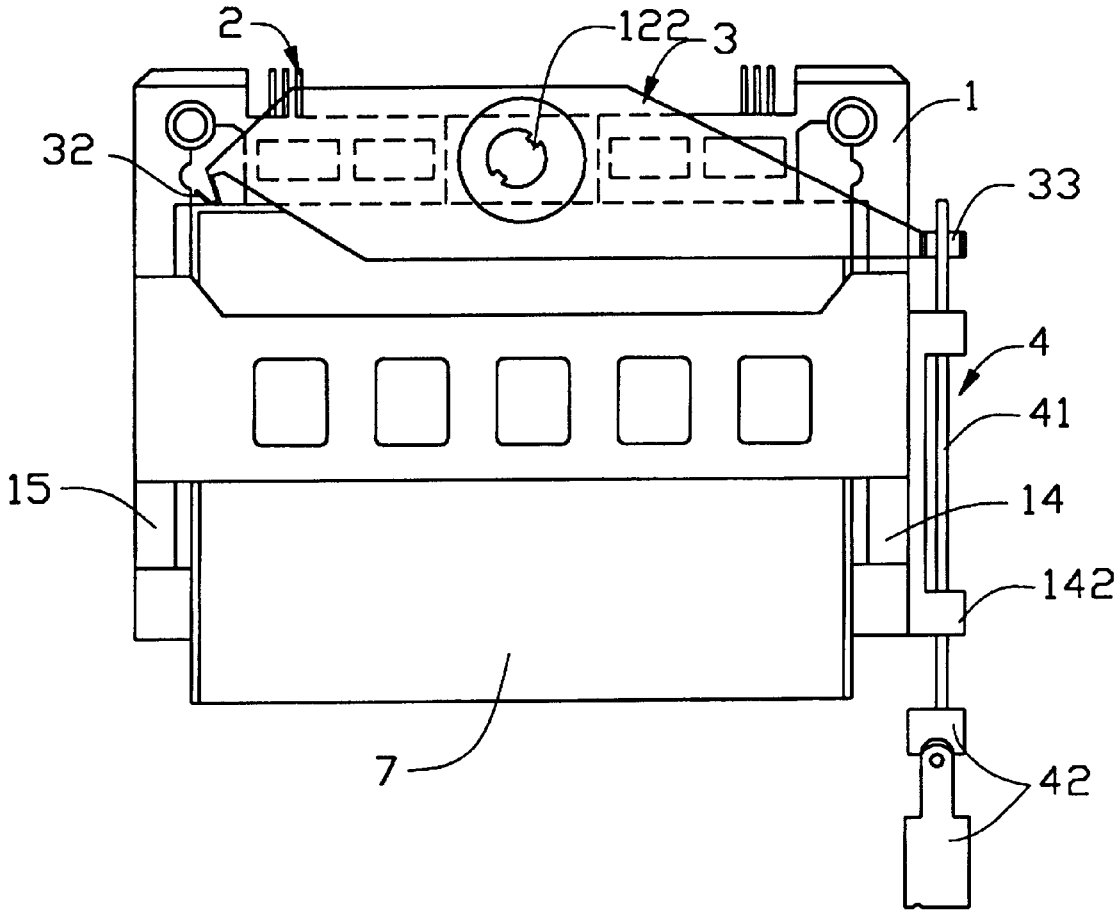
FIG. 4 is a top view of the present invention illustrating the position of a card and the card connector after the card has been completely inserted into the card connector.
Figure 5:
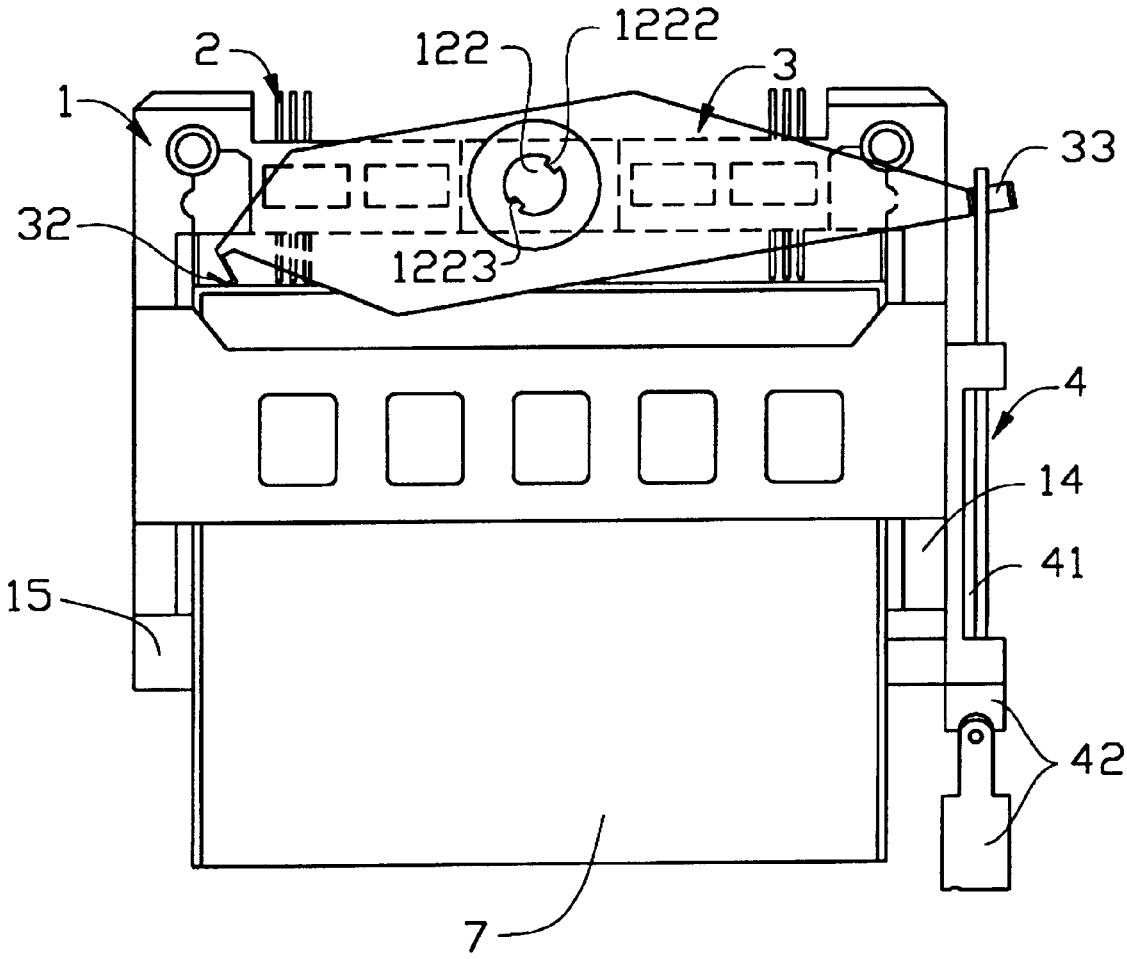
FIG. 5 is a top view similar to FIG. 4 illustrating the ejection of the card from the card connector using the ejector mechanism of the present invention.
Figure 6:
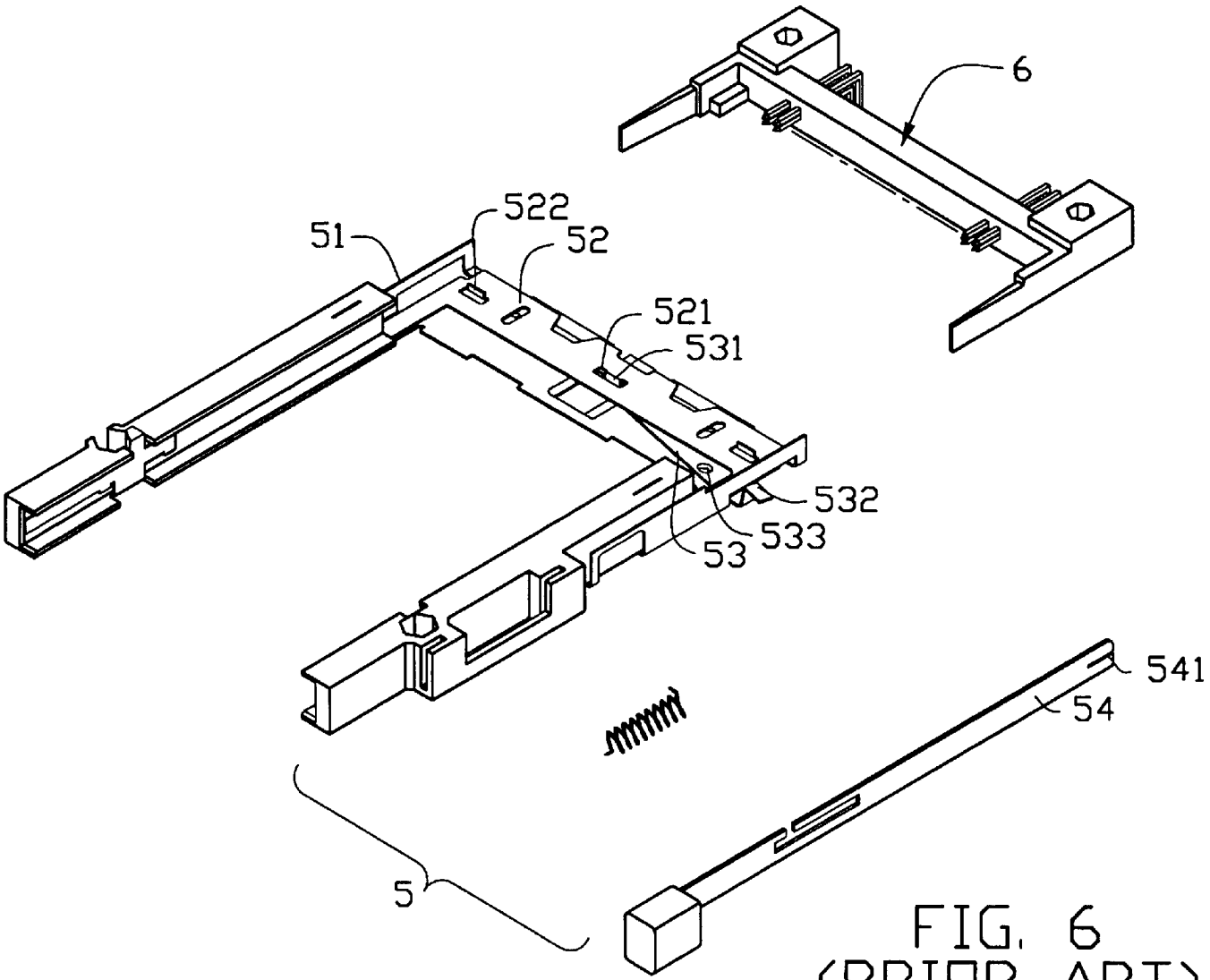
FIG. 6 (PRIOR ART)
FIG. 6 is an exploded view of a conventional card connector.

FIG. 4 illustrates the relationships of a card 7 and the present card connector prior to extracting the card 7, the extraction piece 32 of the extraction plate 3 abutting a front end of the inserted card 7 when the card 7 is fully inserted and engaging with the terminals 2. When ejecting the card 7 from the card connector, as shown in FIG. 5, a force is applied to the push button 42 which pushes the lever 41 to move forward toward the housing 1. Since the extraction plate 3 is connected with the front end of the lever 41 by the locking hook 33, the force pushing forward on the locking hook 33 rotates the extraction plate 3 about the locking member 122. The rotation of the extraction plate 3 exerts an ejecting force by the extraction piece 32 against the front end of the inserted card 7 which ejects the card 7 from the card connector.

The number of parts in the ejection mechanism of the present invention is greatly decreased and assembly is simple. Additionally, no machined parts are required. Consequently, assembly is simplified and cost is reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card connector comprising:

a dielectric housing including a header body, rows of terminal receiving passageways defined through the header body, and a pair of guiding arms extending from opposite ends of the header body for receiving and guiding a card to the dielectric housing, a locking member being integrally formed on an upper surface of the header body;

a plurality of conductive terminals being received within the terminal receiving passageways; and an ejection mechanism including a push rod slidably mounted to one of the guiding arms and an extraction plate pivotably connected with the locking member and engaged with the push rod, the extraction plate forming a recessed portion which defines a locking hole in a central portion, the extraction plate being orientable in a non-operating position for permitting the locking member to enter the locking hole and in a normal operating position for being prevented from disengaging the locking member;

wherein an annular flange extends from a top of the locking member, the annular flange defining a pair of diametrically opposite notches for a controlled engagement of the locking member with the extraction plate;

wherein a periphery of the locking hole includes a pair of diametrically disposed tags respectively corresponding to the notches of the flange of the locking member;

wherein the extraction plate has an extraction piece extending from one end thereof and a bent locking hook formed at another end thereof;

wherein a locking slot is defined in a distal end of the push rod for engaging with the locking hook of the extraction plate;

wherein a pair of receiving protrusions is integrally formed on an outer side of the guiding arm and each receiving protrusion defines a slot for receiving the lever of the push rod;

wherein a recess is formed on the upper surface of the dielectric housing thereby adapted to accommodate the recessed portion which is formed in a central portion of the extraction plate.

* * * * *